US010578084B2

(12) United States Patent
Desumeur et al.

(10) Patent No.: US 10,578,084 B2
(45) Date of Patent: Mar. 3, 2020

(54) HYDRAULIC DEVICE WITH RADIAL PISTONS COMPRISING AT LEAST ONE BALL BEARING

(71) Applicant: POCLAIN HYDRAULICS INDUSTRIE, Verberie (FR)

(72) Inventors: Herve Desumeur, Verberie (FR); Adam Frey, Verberie (FR); Patrick Jalabert, Verberie (FR); Francois-Xavier Lelay, Verberie (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 313 days.

(21) Appl. No.: 15/536,108

(22) PCT Filed: Dec. 17, 2015

(86) PCT No.: PCT/EP2015/080353
§ 371 (c)(1),
(2) Date: Jun. 14, 2017

(87) PCT Pub. No.: WO2016/097216
PCT Pub. Date: Jun. 23, 2016

(65) Prior Publication Data

US 2017/0335831 A1 Nov. 23, 2017

(30) Foreign Application Priority Data

Dec. 17, 2014 (FR) ..... 14 62670

(51) Int. Cl.
*F04B 1/047* (2020.01)
*F04B 1/0404* (2020.01)
(Continued)

(52) U.S. Cl.
CPC ..... *F04B 1/047* (2013.01); *F03C 1/002* (2013.01); *F03C 1/0403* (2013.01);
(Continued)

(58) Field of Classification Search
CPC ..... F04B 15/08; F04B 2015/081; F04B 2015/0822
See application file for complete search history.

(56) References Cited

U.S. PATENT DOCUMENTS 3,593,621 A * 7/1971 Praddaude ..... F03C 1/045 91/498
3,760,691 A * 9/1973 Kleckner ..... F03C 1/0409 91/492
(Continued)

FOREIGN PATENT DOCUMENTS

FR 2588616 4/1987
FR 2996268 4/2014

OTHER PUBLICATIONS

Poclain Hydraulics Industrie, "French Preliminary Search Report and Written Opinion," FR Application No. 1462670 (dated Aug. 5, 2015) (with English translation cover sheet).
(Continued)

*Primary Examiner* — Patrick Hamo
(74) *Attorney, Agent, or Firm* — Womble Bond Dickinson (US) LLP

(57) ABSTRACT

The present invention relates to a hydraulic device (10) with radial pistons, comprising:
- a shaft (12) arranged along an axis (1);
- a cover (13) forming a casing element, the cover and the shaft being free to rotate with respect to one another;
- a distribution assembly comprising:
  - a multi-lobe cam (14);
  - a cylinder block (15);
  - a distributor (16) configured to exert a thrust force (P) against the cylinder block (15) along the axis (11) of the shaft;
  - an assembly (22) of mechanical bearings comprising at least one mechanical bearing (22*a*) mounted in radial
(Continued)

contact between the cover (13) and shaft (12), said assembly being configured to take up the thrust force (P) exerted by the distributor (16); and a radial contact ball bearing mounted in radial contact between the cover (13) and the shaft (12).

28 Claims, 11 Drawing Sheets

(51) Int. Cl.

| | |
|---|---|
| ***F03C 1/04*** | (2006.01) |
| ***F03C 1/34*** | (2006.01) |
| ***F03C 1/047*** | (2006.01) |
| ***F04B 1/107*** | (2020.01) |
| ***F03C 1/00*** | (2006.01) |
| ***F04B 53/16*** | (2006.01) |

(52) U.S. Cl.

CPC ..... *F03C 1/0435* (2013.01); *F03C 1/0472* (2013.01); *F04B 1/0404* (2013.01); *F04B 1/107* (2013.01); *F04B 53/162* (2013.01)

(56) References Cited

U.S. PATENT DOCUMENTS

| | | | | |
|---|---|---|---|---|
| 4,404,896 | A * | 9/1983 | Allart | F03C 1/045 91/491 |
| 4,532,854 | A * | 8/1985 | Foster | F03C 1/045 91/472 |
| 4,898,076 | A * | 2/1990 | Bigo | F03C 1/045 91/491 |
| 5,186,094 | A * | 2/1993 | Allart | F03C 1/045 91/491 |
| 5,836,231 | A | 11/1998 | Leinonen | |
| 6,443,047 | B1 * | 9/2002 | Cunningham | F04B 1/0439 91/491 |
| 6,843,162 | B2 * | 1/2005 | Shrive | F01B 13/061 91/491 |

OTHER PUBLICATIONS

Poclain Hydraulics Industrie, "International Search Report and Written Opinion," PCT Application No. PCT/EP2015/080353 (dated Mar. 18, 2016) (with English translation cover sheet).

* cited by examiner

HYDRAULIC DEVICE WITH RADIAL PISTONS COMPRISING AT LEAST ONE BALL BEARING

GENERAL TECHNICAL FIELD

The present invention relates to the field of hydraulic devices. More precisely, the present invention relates to the field of hydraulic devices with radial pistons.

STATE OF THE ART

FIG. 1 illustrates a longitudinal section view of a hydraulic device with radial pistons 1 according to the prior art. A similar hydraulic device with radial pistons is for example described in document FR 2 955 903.

The hydraulic device 1 comprises a shaft 2 positioned along an axis of rotation 3 and a cover 4 forming a casing element, free to rotate with respect to one another.

The hydraulic device 1 additionally comprises an assembly including a multi-lobe cam 5, a cylinder block 6 and a distributor 7.

The cam 5 is formed from a ring provided in the cover 4 and comprises, on a radially internal surface, a series of lobes with a sinusoidal type shape overall, distributed evenly around the rotation axis 3.

The cylinder block 6 is placed in the interior of the ring forming the cam 5 and defines a plurality of cylinders oriented radially with respect to the axis of rotation 3 and leading to a peripheral external face of the cylinder block 6 facing the cam 5. A piston is mounted radially sliding respectively in each of the cylinders. Each piston bears on the radially internal surface of the cam 5.

The distributor 7 is adapted to apply a fluid under pressure in a controlled manner to each of the pistons, more precisely in an internal chamber of the cylinders adjoining the pistons, so that the successive bearing of the pistons on the lobes of the cam 5 drives the relative rotation of the cylinder block 6 and of the elements which are linked to it with respect to the cam 5, and therefore to the cover 4, or conversely. To this end, there exists an asymmetry between the number of lobes formed on the cam 5 and the number of associated pistons located in the cylinder block 6.

The hydraulic device 1 also comprises two conical roller bearings 8*a* and 8*b* by means of which the shaft 2 and the cover 4 are mounted so as to rotate with respect to one another. To this end, the bearings 8*a* and 8*b* are mounted in radial contact with the shaft 2 on the one hand and the cover 4 on the other hand, and are arranged on either side of the assembly formed by the cam 5, the cylinder block 6 and the distributor 7. Each bearing 8*a* and 8*b* is also mounted between two axial abutment surfaces provided in the shaft 2 and the cover 4.

However, the conical roller bearings 8*a* and 8*b* must be mounted without axial clearance, so as to ensure that they can take up the axial forces in the hydraulic device 1 and avoid having the bearings 8*a* and 8*b* become detached.

For this purpose, it is necessary in particular to place pre-loading spacers 9*a* or elastic rings 9*b* in axial contact with the bearings 8*a* and 8*b*. The pre-loading spacers 9*a* or the elastic rings 9*b* are for example in axial contact with the bearings 8*a* and 8*b* on the one hand, and with the axial abutment surface of the cover 4 on the other hand, so as to press the bearings 8*a* and 8*b* against the axial abutment surface of the shaft 2, and thus ensure an assembly without axial clearance of the conical roller bearings 8*a* and 8*b* in the hydraulic device 1.

However, the pre-loading spacers 9*a* or the elastic rings 9*b* generate a pre-loading force which induces a resistance at the bearings 8*a* and 8*b*, thus reducing their lifetime.

The use of bearings with conical rollers thus makes it compulsory to replace them frequently.

Moreover, the rollers of the bearings 8*a* and 8*b* are conventionally immersed in lubricating oil designed to reduce friction between the rollers and the inner and outer rings of the bearings 8*a* and 8*b*.

However, by rolling on the inner and outer rings of the bearings 8*a* and 8*b*, the rollers displace the lubricating oil, thus generating additional resistance at the bearings 8*a* and 8*b*.

There exists therefore a need to reduce the resistance induced by conical roller bearings 8*a* and 8*b* of the hydraulic device 1.

PRESENTATION OF THE INVENTION

The present invention has as its purpose to reduce the previously described problems by proposing a hydraulic device with radial pistons comprising:

- a shaft arranged along an axis;
- a cover forming a casing element, the cover and the shaft being free to rotate with respect to one another;
- a distribution assembly comprising:
  - a multi-lobe cam;
  - a cylinder block arranged radially with regard to the cam, said cylinder block comprising a plurality of cylinders wherein are arranged pistons guided so as to slide radially in the respective cylinders of the cylinder block and bearing on the lobes of the cam;
  - a distributor configured to exert a thrust force against the cylinder block along the axis of the shaft so as to successively apply a fluid under pressure to said pistons;
- a first mechanical bearing mounted in radial contact between the cover and the shaft, the first mechanical bearing being a radial contact ball bearing,
- an set of second mechanical bearings comprising at least a second mechanical bearing mounted in radial contact between the cover and the shaft, said set of second mechanical bearings being configured to take up the thrust force exerted by the distributor.

Preferably, the shaft comprises an axial abutment surface against which the cylinder block is pressed when the distributor exerts a thrust force against the cylinder block.

Preferably, the second mechanical bearing is a conical roller bearing or an oblique contact ball bearing.

Preferably, the second mechanical bearing comprises an external cage and an internal cage between which the rolling elements are mounted, axially opposite sides of the internal cage and of the external cage being respectively mounted in axial contact with the shaft and the cover, so as to take up the thrust force.

Preferably, the hydraulic device comprises a sleeve mounted in rotation around the shaft, by means of which the second mechanical bearing is mounted in radial contact and in axial contact with the shaft.

Preferably, the set of second bearings comprises a radial contact ball bearing and a ball thrust bearing.

Preferably, the ball thrust bearing comprises a first cage and a second cage between which are mounted the balls, and the radial contact ball bearing of the assembly comprises an internal cage and an external cage between which are mounted the balls, the first cage being mounted in axial contact with the shaft, and axially opposite sides of the external cage of the radial contact ball bearing of the assembly being respectively mounted in axial contact with the second cage of the ball thrust bearing and the cover, so as to take up the thrust force.

Preferably, the set of second mechanical bearings comprises a needle bearing and a cylindrical roller ball thrust bearing.

Preferably, the cylindrical roller ball thrust bearing comprises a first cage and a second cage between which cylindrical rollers are mounted, the first cage of the cylindrical roller ball thrust bearing being mounted in axial contact with the cover and the second cage of the cylindrical roller ball thrust bearing being mounted in axial contact with the cylinder block, radially opposite sides of the first cage and of the second cage of the cylindrical roller ball thrust bearing being respectively mounted in radial contact with the cover and the cylinder block.

Preferably, the needle bearing comprises an internal cage and an external cage between which the needles are mounted, axially opposite sides of the internal cage of the needle bearing being respectively mounted in axial contact with the shaft and the cover, and axially opposite sides of the external cage of the needle bearing being mounted in axial contact with the cover.

Preferably, the hydraulic device comprises a sleeve mounted in rotation around the shaft by means of which the needle bearing is mounted in radial contact and in axial contact with the shaft.

Preferably, the set of second mechanical bearings is mounted without axial clearance between the shaft and the cover.

Preferably, the external cage of the second mechanical bearing is mounted in axial contact with the cover by means of a pre-loading spacer, so as to ensure assembly without radial clearance of the set of second mechanical bearings between the shaft and the cover.

Preferably, the external cage of the radial contact ball bearing of the set is mounted in axial contact with the second cage of the ball thrust bearing by means of a pre-loading spacer, so as to ensure assembly without axial clearance of the set of second mechanical bearings between the shaft and the cover.

Preferably, the set of second mechanical bearings is positioned around a first side of the distribution assembly arranged in the thrust direction of the distributor against the cylinder block.

Preferably, the hydraulic device comprises two first mechanical bearings arranged on either side of the distribution assembly, said first mechanical bearings being radial contact ball bearings.

Preferably, the first mechanical bearing is positioned from a second side of the distribution assembly arranged opposite to the thrust direction of the distributor against the cylinder block.

Preferably, the first mechanical bearing comprises an internal cage and an external cage between which are mounted the balls, axially opposite sides of the external cage and of the internal cage being respectively mounted in axial contact with the cover and the shaft, so as to obtain a closure of the axial forces by the cover.

Preferably, the set of second mechanical bearings is positioned on the second side of the distribution assembly arranged opposite to the thrust direction of the distributor against the cylinder block.

Preferably, the first mechanical bearing is positioned on the first side of the distribution assembly arranged in the thrust direction of the distributor against the cylinder block.

Preferably, the first mechanical bearing comprises and internal cage and an external cage between which are mounted the balls, axially opposite sides of the internal cage being both mounted in axial contact with the shaft so as to ensure closure of the forces by the shaft.

Preferably, the shaft is hollow and configured to be mounted around a shaft, particularly a differential shaft, said hydraulic device comprising a first ring seal mounted in radial contact with an external surface of one end of the shaft on the one hand, and the cover on the other hand, and a second ring seal mounted in radial contact with an internal surface of said end of the shaft on the one hand and configured to be mounted in radial contact with the shaft on the other hand.

Preferably, the hydraulic device comprises a lock ring comprising a first and a second annular portion connected together by an intermediate portion, the first annular portion of the lock ring being mounted on the external surface of the end of the shaft, and the first ring seal being mounted in radial contact with the end of the shaft by means of said first annular portion, the second annular portion of the lock ring extending from the intermediate portion distancing itself from the end of the shaft, and the second ring seal being mounted in radial contact with the end of the shaft by means of said second annular portion.

Preferably, the internal surface of the end of the shaft is provided with a shoulder forming a space which accommodates the second ring seal.

Preferably, the hydraulic device also comprises an annular band mounted on the external surface of the shaft and by means of which the first ring seal is in radial contact with the end of the shaft.

Preferably, the external surface of the end of the shaft is provided with a shoulder accommodating the first portion of the lock ring or the annular band.

Preferably, the first and the second ring seals are arranged one around the other overall.

PRESENTATION OF THE FIGURES

Other features, aims and advantages of the invention will be revealed by the description that follows, which is purely illustrative and not limiting, and which must be read with reference to the appended drawings, wherein.

DETAILED DESCRIPTION

Figure 1:
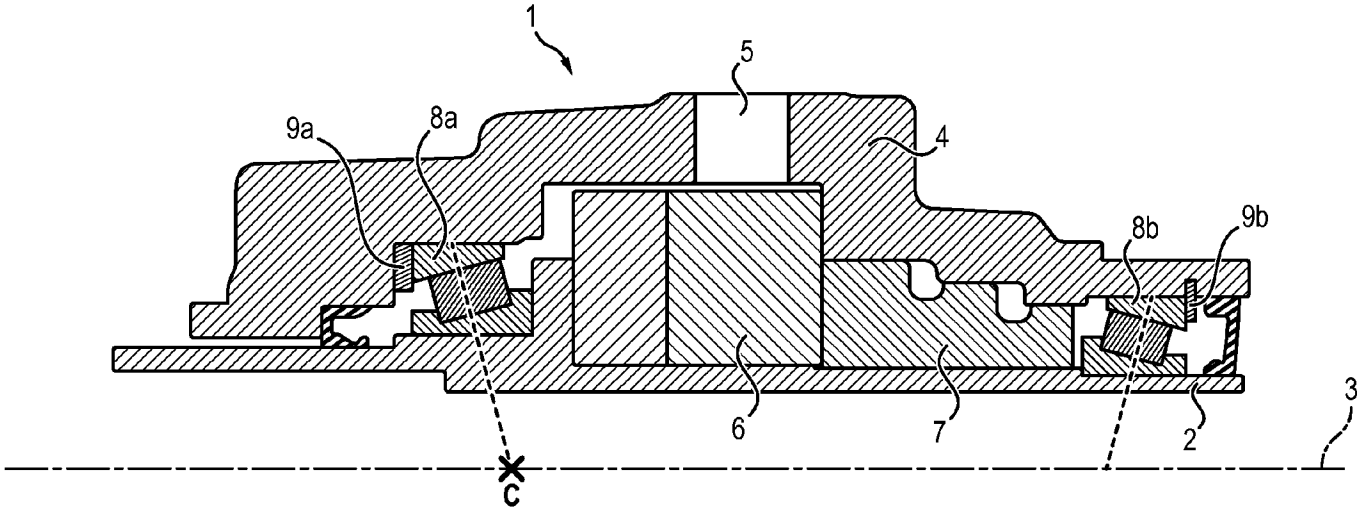
FIG. 1 shows a partial schematic section view of an hydraulic device according to the prior art.

FIGS. 2 through 5 each show a partial section view of an hydraulic device 10 according to a first embodiment of the invention. Shown on this figure is an axis of rotation 11 of the hydraulic device 10. The hydraulic device 10 is preferably a motor. According to one variant, the hydraulic device is a pump.

The hydraulic apparatus 10 comprises a shaft 12 positioned along the axis of rotation 11 and a cover 13 forming a casing element. The shaft 12 and the cover 13 are free to rotate with respect to one another. The cover 12 is preferably fixed, while the shaft 12 is free to rotate around the axis of rotation 11. Preferably, the hydraulic device 10 is configured to transmit only pure torque. In particular, the hydraulic device 10 does not transmit an axial force, generated for example by gearing thrust, nor a radial force, generated for example by the pressure of a wheel.

The hydraulic device 10 also comprises a distribution assembly including a multi-lobe cam 14, a cylinder block 15 and a distributor 16.

The cam 14 is formed by a ring arranged coaxially with the axis of rotation 11 and provided in the cover 13. The ring of the cam 14 is integral with the cover 13. The cam 14 comprises, on a radially internal surface, a series of lobes distributed evenly around the axis of rotation 11. Each of the lobes has a sinusoidal type shape overall.

The cylinder block 15 is mounted on the shaft 12 and is placed inside the ring forming the cam 14. It defines a plurality of cylinders oriented radially with respect to the axis of rotation 11 and leading to an external peripheral face of the cylinder block 15 facing the cam 14. A piston is mounted so as to slide radially respectively in each of the cylinders. Each piston bears on the radially internal surface of the cam 14.

The distributor 16 is mounted on the shaft 12, on a first side of the cylinder block 15 according to the axis of rotation 11. The distributor 16 is adapted to successively apply a fluid under pressure in a controlled manner to each of the pistons, more precisely in an internal chamber of the cylinders adjoining the pistons, so that the successive thrust of the pistons on the lobes of the cam 14 brings about relative rotation of the cylinder block 15 and of the elements linked to it, particularly the shaft 12, with respect to the cam 14 and therefore to the cover 13, or conversely. To this end, there exists an asymmetry between the number of lobes formed on the cam 14 and the number of associated pistons situated in the cylinder block 15.

The distributor 16 is also configured to exert a thrust force P against the cylinder block 15 along the axis of rotation 11. Thus, the distributor 16 and the cylinder block 15 are in fluid-tight contact with one another. The hydraulic device 10 includes for example an elastic return element, such as a tension or compression spring, to press the distributor 16 against the cylinder block 15.

In the examples illustrated in FIGS. 2 through 5, the shaft 12 comprises a shoulder 17 forming an axial abutment surface 18 against which the cylinder block 15 is pressed when the distributor 16 exerts the thrust force P against the cylinder block 15. For this purpose, the axial abutment surface 18 (and the shoulder 17) is provided on a second side of the cylinder block 15 opposite to the first side. Thus, when the distributor 16 presses the cylinder block 15 against the axial abutment surface 18, the thrust force P is transmitted to the shaft 12.

In the examples illustrated in FIGS. 2 through 5, the distribution assembly also comprises an actuator 19 configured to engage and disengage the cylinder block 15. For this purpose, the actuator 19 is mounted on the shaft 12 on the second side of the cylinder block 15, between the axial abutment surface 18 and the cylinder block 15. The actuator 19 is adapted to selectively immobilize the cylinder block 15 with respect to the shaft 12. The actuator 19 is configured to immobilize the cylinder block 15 relative to the shaft 12 when it is desired that the rotation of the cylinder block 15 with respect to the cam 14 cause the rotation of the shaft 12. In the examples illustrated in FIGS. 3 and 5, the actuator 19 is a stack of disks. As a variant, the actuator 19 has a bearing surface adapted to engage the cylinder block 15. The bearing surface 20 is for example a radial collar arranged so as to engage by friction a lateral surface of the cylinder block 15. According to a variant, a claw coupling is used, that is a device with teeth and grooves positioned on the actuator 19 and on the cylinder block 15, allowing them to be immobilized in rotation when the teeth and the grooves are engaged. According to another variant, a friction path is arranged on the actuator 19 and/or on the cylinder block 15. In particular, the actuator 19 can have a friction cone designed to come into contact with a cone of complementary shape provided on the cylinder block 15 so as to engage it.

The hydraulic device 10 also comprises a first mechanical bearing 21 and a set 22 of second mechanical bearings comprising at least one second mechanical bearing by means of which the shaft 12 and the cover 13 are mounted in rotation with respect to one another. To this end, the first mechanical bearing 21 and the second mechanical bearing(s) 22 are mounted in radial contact with the shaft 12 on the one hand and the cover 13 on the other hand.

The set 22 of second mechanical bearings is configured to take up the thrust force P exerted by the distributor 16.

The first mechanical bearing 21 is a radial contact ball bearing comprising an external cage and an internal cage, between which are mounted the balls. What is meant by a "radial contact ball bearing" is a ball bearing wherein the resultant of the contact force of the external cage and of the internal cage has only a radial component, in contrast for example to an oblique contact ball bearing the resultant whereof will have both a radial component and an axial component. The first mechanical bearing 21 is for example a deep groove ball bearing. The radial contact ball bearing 21 is configured to take up axial forces of low amplitude compared to the thrust force P.

Figure 2:
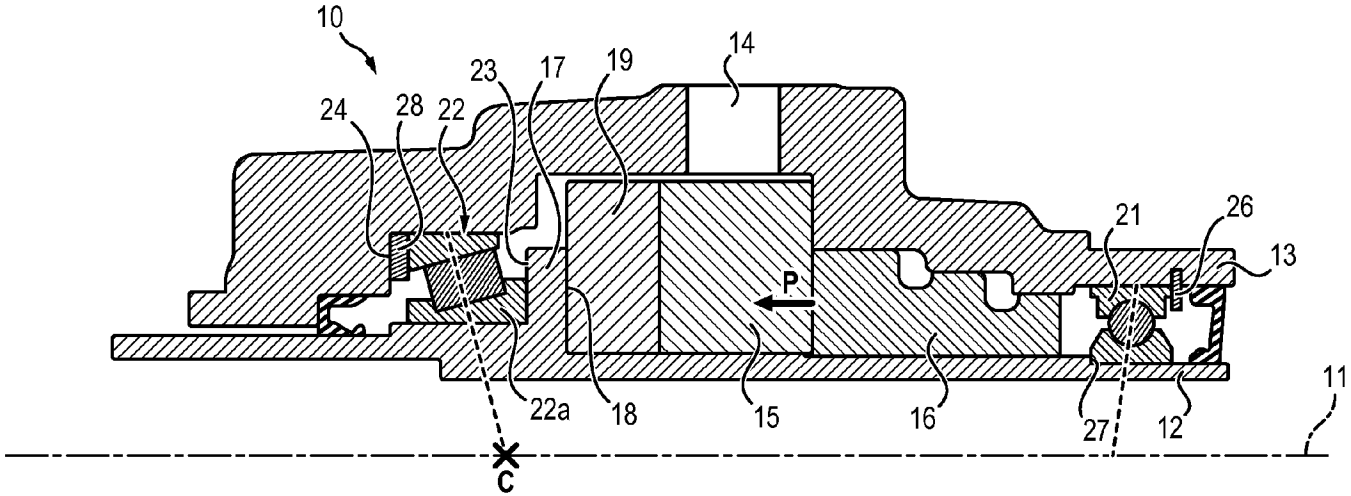
FIG. 2 shows a partial schematic section view of an example of a hydraulic device according to a first embodiment of the invention.
Figure 3:
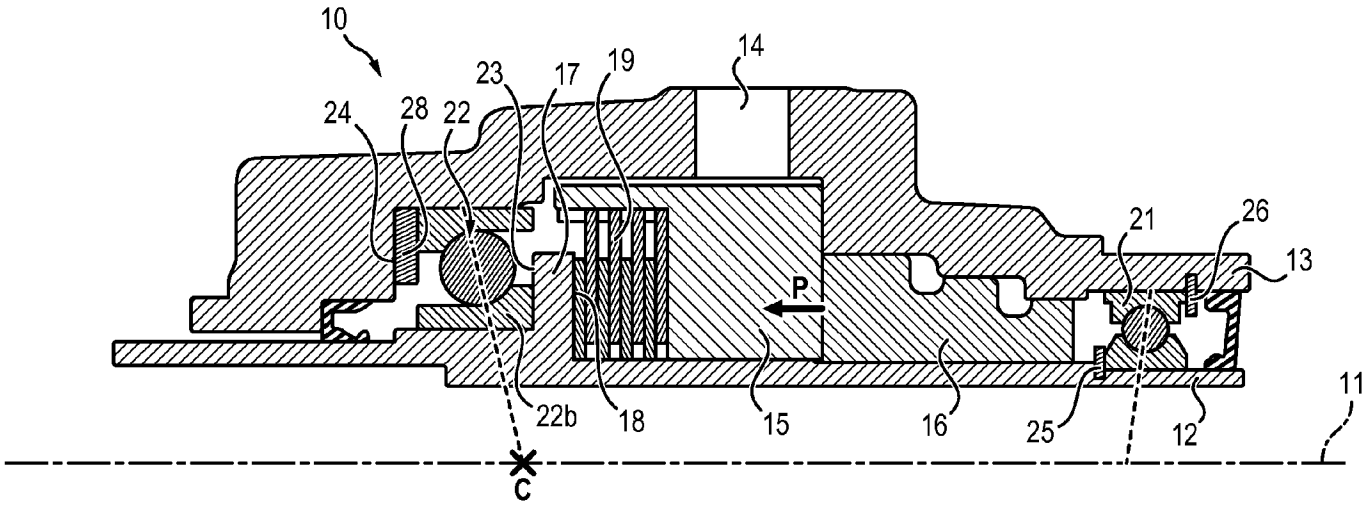
FIG. 3 shows a partial schematic section view of another example of an hydraulic device according to the first embodiment of the invention.
Figure 4:
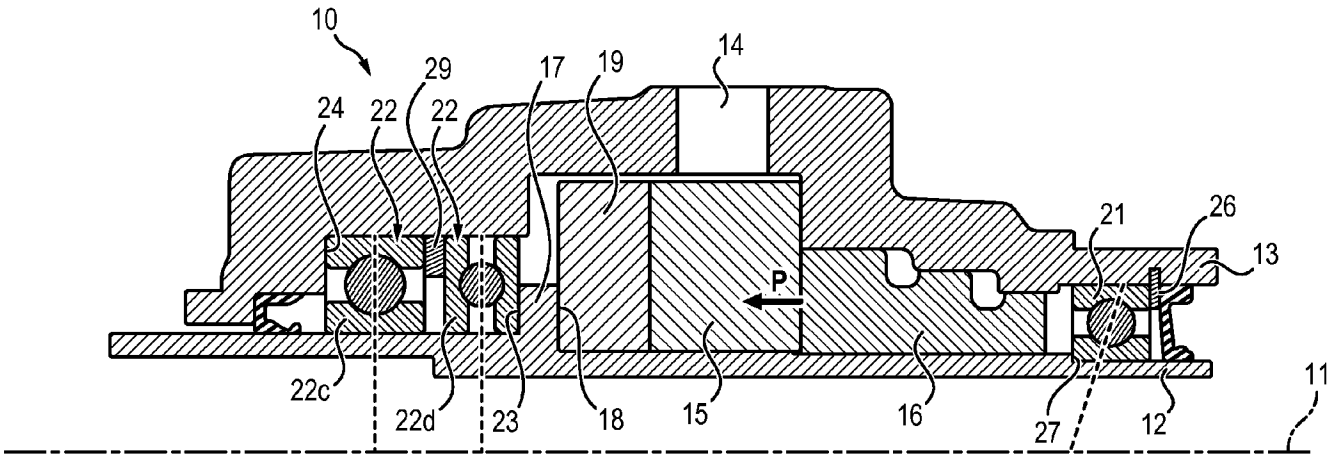
FIG. 4 shows a partial schematic section view of another example of the hydraulic device according to the first embodiment of the invention.

In the examples illustrated in FIGS. 2 through 4, the set 22 of second mechanical bearings is positioned on a first side of the distribution assembly arranged in the thrust direction of the distributor 16 against the cylinder block 15. In other words, the set 22 of second mechanical bearings is arranged opposite to the distributor 16 relative to the cylinder block 15. In these examples, the first mechanical bearing 21 is also positioned on a second side of the distribution assembly positioned opposite to the thrust direction of the distributor 16 against the cylinder block 15.

In the example illustrated in FIG. 2, the assembly 22 of second mechanical bearings comprises a conical roller bearing **22*a*** having an internal cage and an external cage between which the conical rollers are mounted.

The conical roller bearing 22*a* is arranged so that the axial resultant of the thrust force exerted by the conical rollers on the internal cage of the conical roller bearing 22*a* is in the opposite direction to the thrust force P of the distributor 16 on the cylinder block 15. In other words, the conical roller bearing 22*a* is positioned so that its center of thrust C on the axis of rotation 11 is offset toward the distribution assembly.

In the example illustrated in FIG. 3, the set 22 of second mechanical bearings comprises an oblique contact ball bearing 22*b* having an internal cage and an external cage between which are mounted the balls.

The oblique contact ball bearing 22*b* is positioned so that the axial resultant of the thrust force P exerted by the balls on the internal ring of the oblique contact ball bearing 22*b* is in the direction opposite to the thrust force P of the distributor 16 on the cylinder block 15. In other words, the oblique contact ball bearing 22*b* is positioned so that its center of thrust C on the axis of rotation 11 is offset toward the distribution assembly.

In the examples illustrated in FIGS. 2 and 3, axially opposite sides of the internal cage and of the external cage of the second mechanical bearing 22*a*, 22*b* are respectively mounted in axial contact with the shaft 12 and the cover 13. For this purpose, the internal cage of the second mechanical bearing 22*a*, 22*b* is for example in axial contact with a second axial abutment surface 23 provided on the shoulder 17 of the shaft 13, opposite to the first axial abutment surface 18, and a side of the external cage of the second mechanical bearing 22*a*, 22*b*, opposite to the shoulder 17 is for example in axial contact with an axial abutment surface 24 provided in the cover 13.

It will be understood that such an assembly makes it possible to ensure that the thrust force P exerted by the distributor 16 on the cylinder block 15, which is transmitted to the shaft 12, is taken up.

In the example illustrated in FIG. 4, the set 22 of second mechanical bearings comprises a radial contact ball bearing 22*c* having an external cage and an internal cage between which are mounted the balls, and a ball thrust bearing 22*d* having a first cage and a second gage between which balls are mounted.

In the example illustrated in FIG. 4, the first cage of the ball thrust bearing 22*d* is mounted in axial contact with the shaft 12, particularly with the second axial abutment surface 23 of the shaft 12. In this example, axially opposite sides of the external cage of the radial contact ball bearing 22*c* are respectively mounted in axial contact with the second cage of the ball thrust bearing 22*d* and the cover 13.

Thus, the set 22 of second mechanical bearings makes it possible to ensure that the thrust force P exerted by the distributor 16 on the cylinder block 15, which is transmitted to the shaft 12, is taken up.

Preferably, the set 22 of second mechanical bearing is mounted in the axial clearance between the shaft 12 and the cover 13, so as to ensure that the axial forces in the hydraulic device 10 are taken up and in particular to avoid having the set 22 of second mechanical bearings become detached.

In the examples illustrated in FIGS. 2 and 3, the external cage of the second mechanical bearing 22*a*, 22*b* is mounted in axial contact with the cover 13 by means of a pre-loading spacer 28, so as to ensure assembly without axial clearance of the set 22 of second mechanical bearings between the shaft 12 and the cover 13. As a variant, to dispense with the pre-loading spacer 28, the hydraulic device 10 can be dimensioned so that the second mechanical bearing 22*a*, 22*b* is mounted without axial clearance between the shaft 12 and the cover 13.

In the example illustrated in FIG. 4, the external cage of the radial contact ball bearing 22*c* is mounted in axial contact with the second cage of the ball thrust bearing 22*d* by means of a pre-loading spacer 29, so as to ensure assembly without axial clearance of the set 22 of second mechanical bearings between the shaft 12 and the cover 13. In this example, the internal cage of the radial contact ball bearing 22*c* is not in axial contact with any part. As a variant, to dispense with the pre-loading spacer 29, the hydraulic device 10 can be dimensioned so that the second mechanical bearings 22*c*, 22*d* are mounted without axial clearance between them and between the shaft 12 and the cover 13.

The pre-loading spacer 28, 29 or the dimensioning of the hydraulic device 10 without axial clearance, induce an axial preload of small amplitude comparatively to the thrust force P. As described hereafter, this force is taken up by the first mechanical bearing 21.

In the examples illustrated in FIGS. 2 through 4, opposite sides of the external cage and of the internal cage of the first mechanical bearing 21 are respectively mounted in axial contact with the cover 13 and the shaft 12, so as to obtain closure of the axial forces by the cover 13 and to take up the preloading force applied to the set 22 of second mechanical bearings. For this purpose, the internal cage of the first mechanical bearing 21 is for example mounted in axial contact with the shaft 12 by means of a first elastic ring 25 mounted in a groove provided on the shaft 12, between the first mechanical bearing 21 and the distribution assembly (FIG. 3), and the external cage of the first mechanical bearing 21 is for example mounted in axial contact with the cover 13 by means of the second elastic ring 26 mounted in a groove provided on the cover 13 on a side of the first mechanical bearing 21 opposite to the first elastic ring 25. As a variant, the first elastic ring 25 can be replaced by a shoulder having an axial abutment surface 27 (FIGS. 2 and 4). It will be understood that such an assembly allows the first mechanical bearing 21 to take up the pre-loading force applied to the set 22 of second mechanical bearings.

Figure 5:
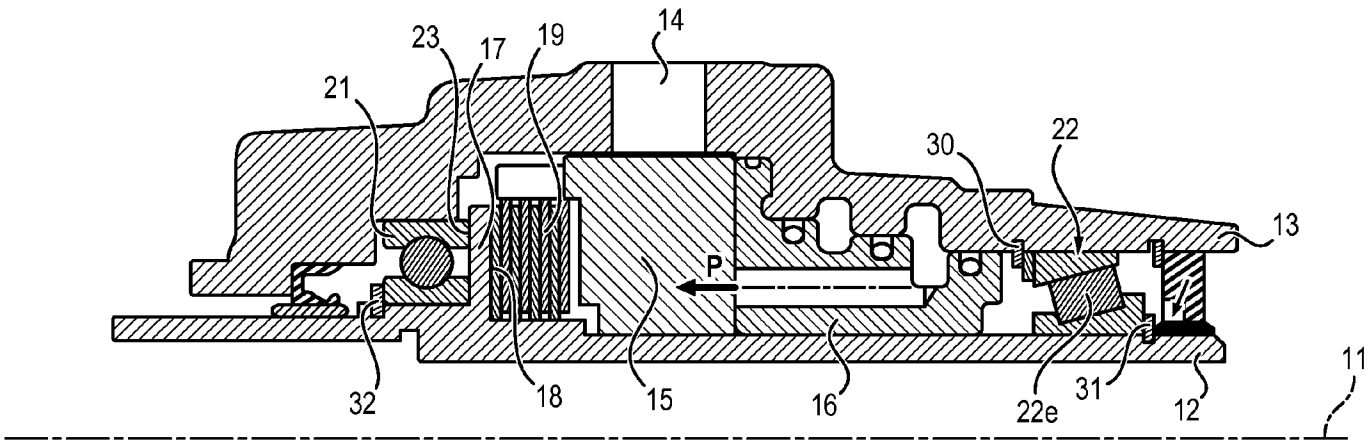
FIG. 5 shows a partial schematic section view of another example of the hydraulic device according to the first embodiment of the invention.

In the example illustrated in FIG. 5, the set 22 of second mechanical bearings is positioned on the second side of the distribution assembly. In other words, the set 22 of second mechanical bearings is arranged opposite to the actuator 19 relative to the cylinder block 15. In this example, the first mechanical bearing 21 is also positioned on the first side of the distribution assembly. Such an assembly makes it possible in particular to simplify and lighten the cover 13 on the first side of the distribution assembly, the coupling (that is the transmission of torque) being generally accomplished on this side of the distribution assembly.

In the example illustrated in FIG. 5, the set 22 of second mechanical bearings comprises a conical roller bearing 22*e* having an internal cage and an external cage between which are mounted the conical rollers. As a variant, the set 22 of second mechanical bearings can comprise the second mechanical bearing(s) 22*b*; 22*c*, 22*d* described in connection with FIGS. 3 and 4.

The conical roller bearing 22*e* is arranged so that the axial resultant of the thrust force P exerted by the conical rollers on the internal cage of the conical roller bearing 22*e* is in the opposite direction to the thrust force P of the distributor 16 on the cylinder block 15. In other words, the conical roller bearing 22*e* is positioned so that its center of thrust C on the axis of rotation 11 is offset to distance it from the distribution assembly.

In the example illustrated in FIG. 5, axially opposite sides of the internal cage and of the external cage of the second mechanical bearing 22*e*, 22*b* are respectively mounted in axial contact with the shaft 12 and the cover 13. For this purpose, the external cage of the second mechanical bearing 22*e* is for example mounted in axial contact with the cover 13 via a first elastic ring 30 mounted in a groove provided on the cover 13, between the second mechanical bearing 22*e* and the distribution assembly, and the internal cage of the second mechanical bearing 22*e* is for example mounted in axial contact with the shaft 12 via a second elastic ring 31 mounted in a groove provided on the shaft 12 on a side opposite the first elastic ring 30.

It will be understood that such an assembly makes it possible to take up the thrust force P exerted by the distributor 16 on the cylinder block 15, which is transmitted to the shaft 12.

In the example illustrated in FIG. 5, axially opposite sides of the internal cage of the first mechanical bearing 21 are both mounted in axial contact with the shaft 12, so as to obtain closure of the forces by the shaft 12. For this purpose, the internal cage of the first mechanical bearing 21 is for example mounted in axial contact with the second axial abutment surface 23 of the shaft 12 on the one hand, and with the shaft 12 by means of an elastic ring 32 on the other hand. The external cage of the first mechanical bearing 21 is for example mounted in axial contact with the second axial abutment surface 23 of the shaft 12 and, on the opposite side of the shoulder 17, at a distance from the axial abutment surface 24 of the cover 13. It will be understood that by not transmitting any force from the shaft 12 to the cover 13, the first mechanical bearing 21 makes it possible for the set 22 of second mechanical bearings to take up the thrust force P which the distributor 16 exerts on the cylinder block 15.

Figure 10:
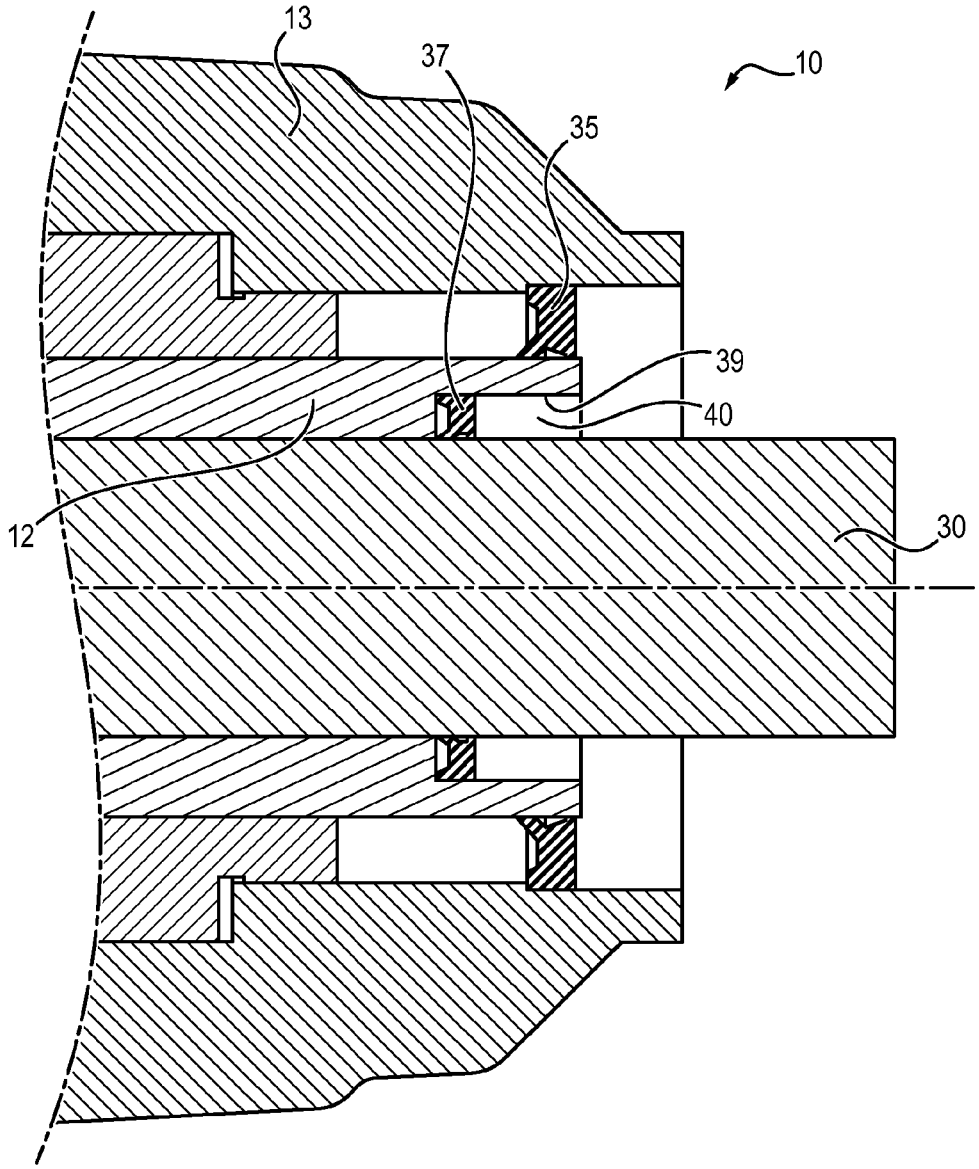
FIG. 10 shows a partial schematic section view of a variant of the sealing device illustrated in FIG. 9.
Figure 11:
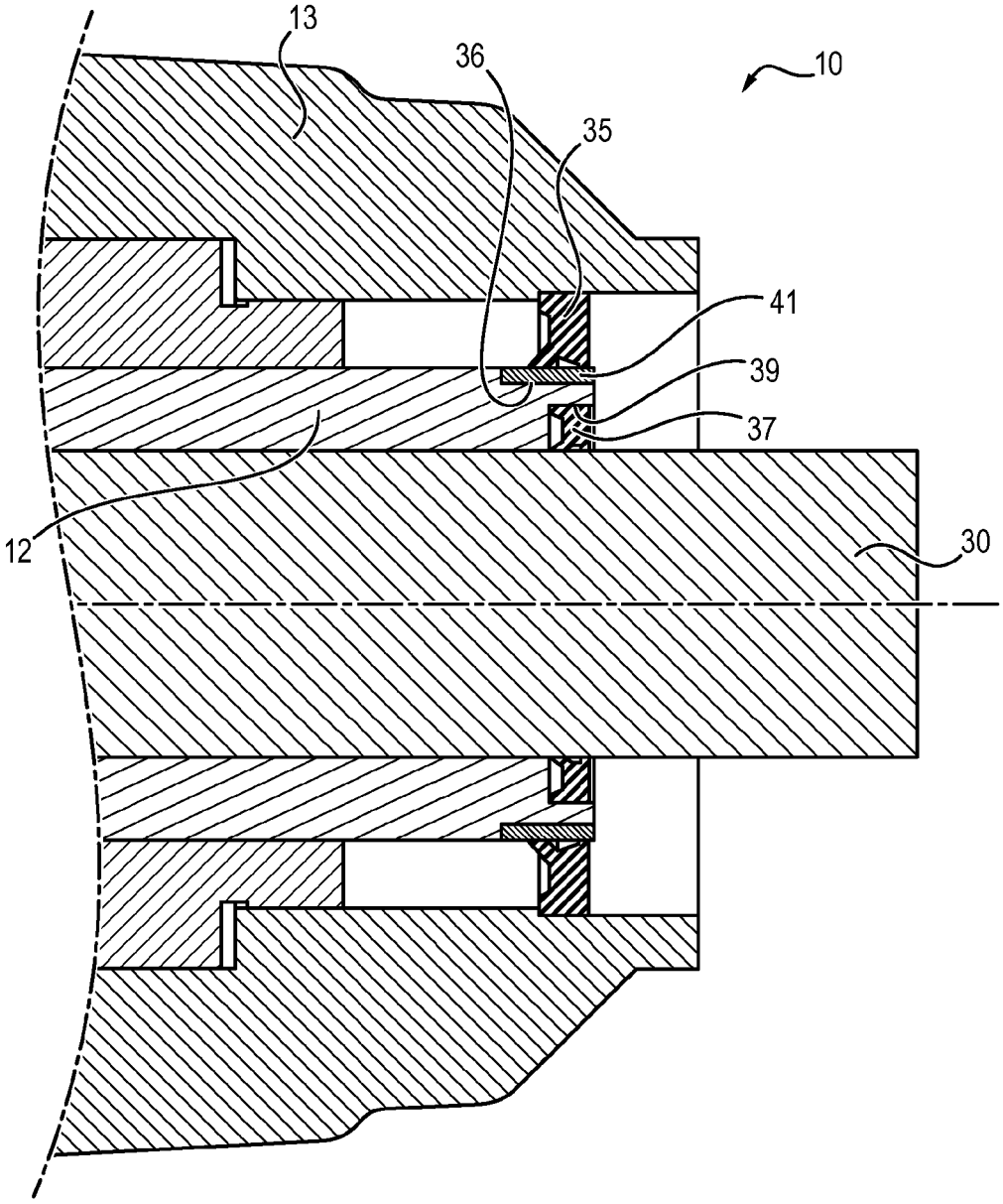
FIG. 11 shows a partial schematic section view of a variant of the sealing device illustrated in FIG. 10.

As illustrated in FIGS. 2 through 5, the shaft 12 is hollow and configured to be mounted around a shaft, this shaft possibly being a differential shaft 30. The differential shaft 30 is coupled with a differential (not shown) associated with a gearbox (not shown) at its end arranged opposite to the distributor 16 with respect to the cylinder block 15. In order to ensure fluid-tightness both between the differential shaft 30, and hence the differential and/or the gearbox, and the shaft 12, and inside the hydraulic device 10 between the shaft 12 and the cover 13, the hydraulic device 10 comprises a sealing device of which several variants are illustrated in FIGS. 9, 10 and 11.

For this purpose, the sealing device comprises a first ring seal 35 mounted in radial contact with an external surface of an end of the shaft 12, arranged on the side of the distributor 16 with respect to the cylinder block 15, on the one hand and the cover 13 on the other hand, and a second ring seal 37 mounted in radial contact with the internal surface of said end of the shaft 12 on the one hand and configured to be mounted in radial contact with the differential shaft 30 on the other hand.

Figure 9:
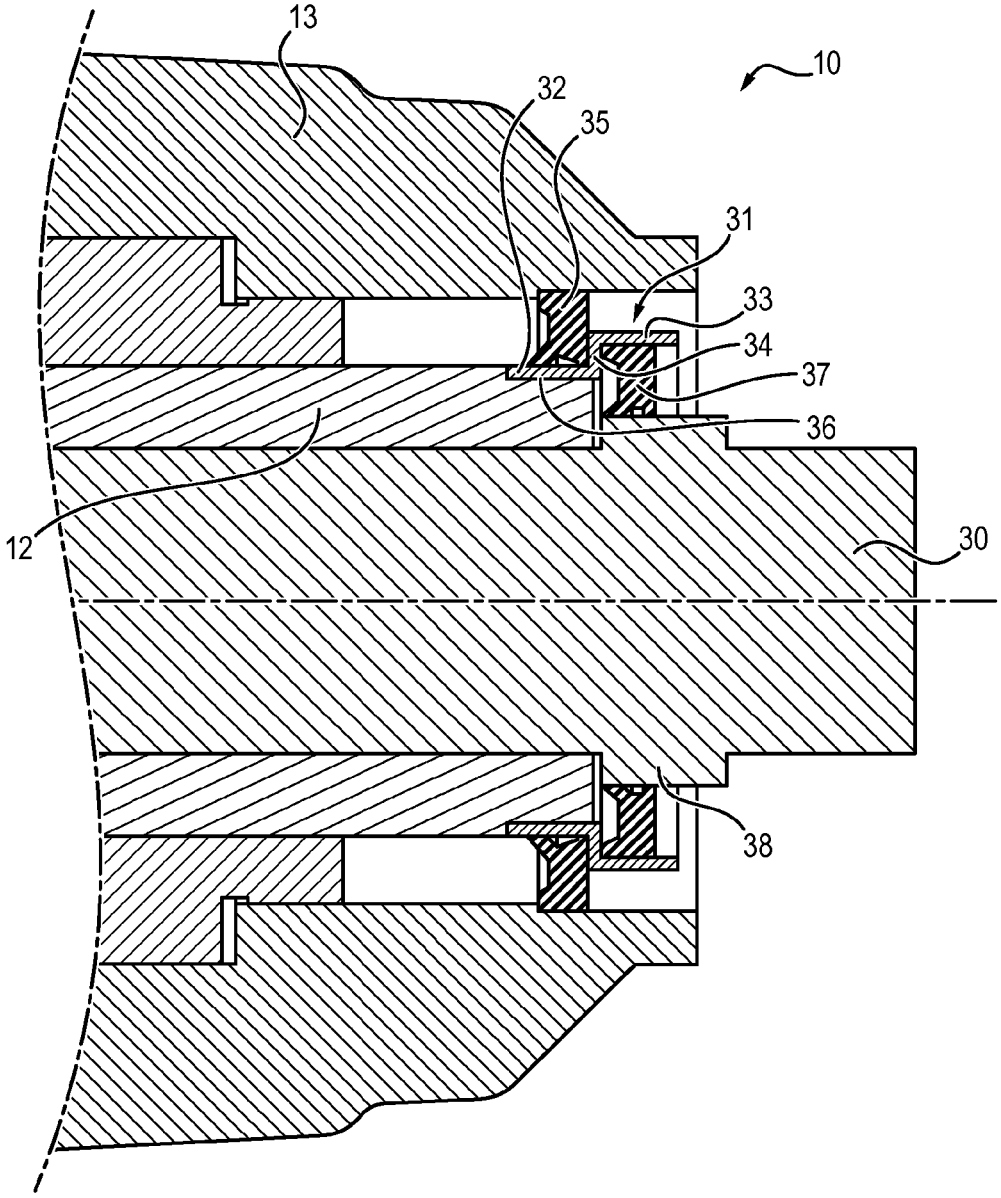
FIG. 9 shows a partial schematic section view of a sealing device of the hydraulic device illustrated in FIG. 2.

In the variant illustrated in FIG. 9, the hydraulic device 10 is provided with a lock ring 31 comprising a first and a second concentric annular portions 32, 33, the first annular portion 32 having a smaller diameter than that of the second annular portion 33, and connected to one another by an intermediate portion 34 preferably extending radially between said first and second annular portions 32, 33. The lock ring 31 therefore has an "S"-shaped profile overall.

The first annular portion 32 of the lock ring 31 is mounted on the external surface of the end of the shaft 12. The first ring seal 35 is mounted in radial contact with the first annular portion 32 of the lock ring 31 on the one hand, and with the cover 13 on the other hand, thus ensuring the fluid-tightness of the hydraulic device 10. The first ring seal 35 is therefore mounted in radial contact with the shaft 12 by means of the first annular portion 32 of the lock ring 31. The first annular portion 32 of the lock ring 31 thus serves as a friction surface for the first ring seal 35. The first ring seal 35 is placed for example against the intermediate portion 34 of the lock ring 31. A shoulder 36 is provided for example at the end of the shaft 12 to accommodate the first annular portion 32 of the lock ring 31.

The second annular portion 33 of the lock ring 31 extends from the intermediate portion 34 distancing itself from the end of the shaft 12. The second ring seal 37 is mounted in radial contact with the second annular portion 33 of the lock ring 31, on the one hand, and with the differential shaft 30 on the other hand, thus ensuring the seal between the differential shaft 30, and thus the differential, and/or the gearbox, and the shaft 12 of the hydraulic device 10. The second ring seal 37 is therefore mounted in radial contact with the shaft 12 by means of the second annular portion 33 of the lock ring 31. The first and second ring seals 35, 37 are mounted on opposite faces of the lock ring 31. The second annular portion 33 of the lock ring 31 forms a housing around the differential shaft 30 to accommodate the second ring seal 37. The differential shaft 30 has a collar 38 for example on which is mounted the second ring seal 37.

In one embodiment (not shown), the two annular portions 32 and 33 of the lock ring 31 have the same diameter.

As a variant, the second annular portion 33 of the lock ring 31 has a smaller diameter than the diameter of the first annular portion 32 of the lock ring 31.

In the variant illustrated in FIG. 10, the internal surface of the end of the shaft 12 is provided with a shoulder 39 forming a housing 40 between the shaft 12 and the differential shaft 30, accommodating the second ring seal 37.

The variant illustrated in FIG. 11 differs from the variant illustrated in FIG. 10 in that an annular band 41 is also mounted on the external surface of the end of the shaft 12 and is interposed between the first ring seal 35 and the shaft 12. The first ring seal 35 of the lock ring 31 is therefore in radial contact with the shaft 12 by means of the annular band 41. The external surface of the end of the shaft 12 is for example provided with a shoulder 36 accommodating the lock ring 41. The annular band 41 makes it possible to improve the friction surface between the first ring seal 35 and the shaft 12.

Moreover, to gain compactness in the two variants, the first and the second ring seals 35, 37 can be positioned at least partially one around the other.

Figure 6:
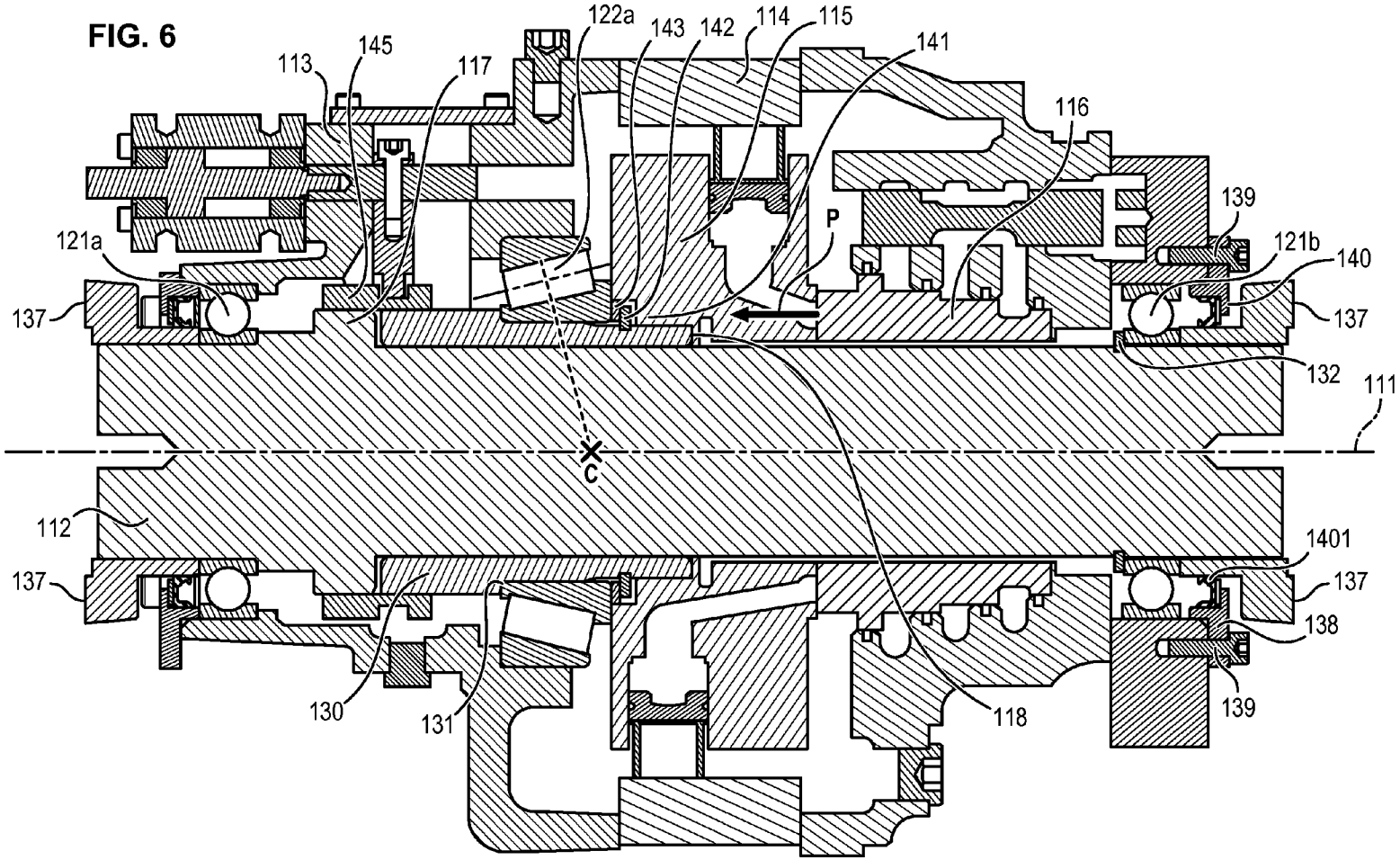
FIG. 6 shows a partial schematic section view of another example of the hydraulic device according to a second embodiment of the invention, said hydraulic device being in the engaged configuration.
Figure 7:
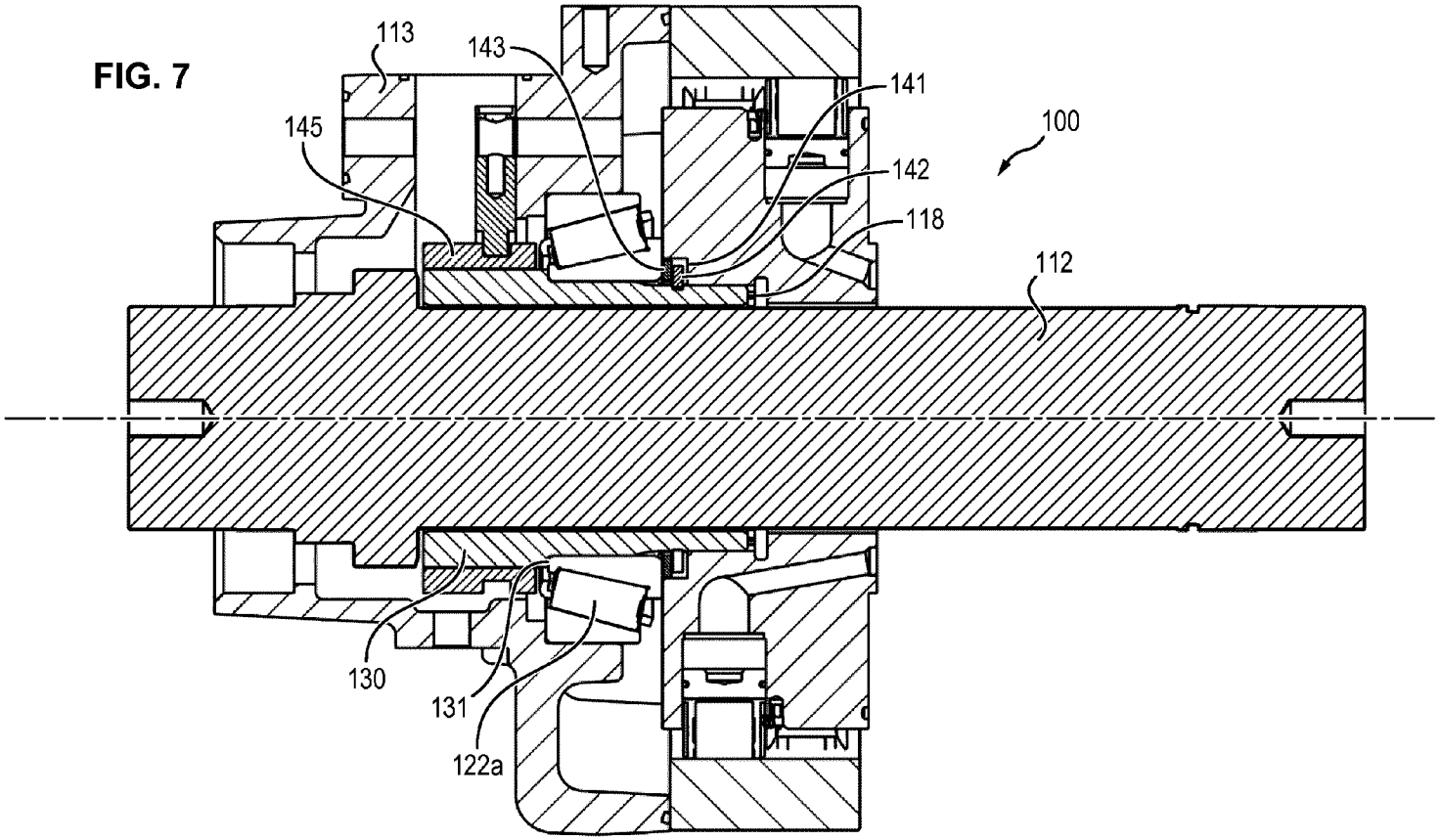
FIG. 7 shows a partial schematic section view of the hydraulic device illustrated in FIG. 6 in the disengaged configuration.

FIGS. 6 and 7 show a partial section view of a hydraulic device 100 according to a second embodiment of the invention. Represented on these figures is an axis of rotation 111 of the hydraulic device 100. The hydraulic device 100 is preferably a motor. According to one variant, the hydraulic device is a pump.

The hydraulic device 100 comprises a shaft 112 positioned along the axis of rotation 111 and a cover 113 forming a casing element. The shaft 112 and the cover 113 are free to rotate with respect to one another. The cover 113 is preferably fixed, while the shaft 112 is free to rotate around the axis of rotation 111. Preferably, the hydraulic device 100 is configured to transmit only pure torque. In particular, the hydraulic device 100 does not transmit any axial force, generated by gear thrust for example, nor any radial force, generated for example by the pressure of a wheel.

The shaft 112 is a through shaft and can be disengaged. The opposite ends of the shaft 112 along the axis of rotation 111 are designed to be coupled to external shafts (not shown). To increase the transmission of torque between the external shafts and the shaft 112, the ends of the shaft 112 are provided with contact faces 137 designed to come into contact with the external shafts, which have undergone shot peening followed by a hardening surface treatment. Thus, the contact faces 137 are rough and constitute friction surfaces allowing a considerable torque to be transmitted between the shaft 112 and the external shafts.

In the examples illustrated in FIGS. 6 and 7, the hydraulic device 100 also comprises a seal support ring 138. The seal support ring 138 extends around the shaft 112, at one of the ends of the latter, and is in axial contact with the cover 113. The seal support ring 138 is maintained for example in axial contact with the cover 113 and attached to said cover 113 by means of a plurality of screws 139 distributed over the entire circumference of the ring 138. A lip 140 also extends axially from the seal support ring 138, in radial contact with the cover 113 so as to form a space between the lip 140, the ring 138 and the shaft 112, accommodating a seal and thus ensuring fluid-tightness of the hydraulic device 100. The seal support ring 138 is particularly advantageous because it is easily replaceable during maintenance of the hydraulic device 100. Such a seal support ring 138 can be mounted at one or the other or even both ends of the shaft 112.

The hydraulic device 100 is used for example as a motor for motor vehicles with hydrostatic and mechanical drive. During a mechanical drive phase, the hydraulic device 100 is disengaged and the shaft 112 is driven by the heat engine via a gearbox of the vehicle. In hydrostatic drive, the hydraulic device 100 is engaged and drives the shaft 112, the gearbox of the heat engine being in neutral in this case and the heat engine driving the pump supplying the oil flow required for the operation of the hydraulic device 100.

The hydraulic device 100 also comprises a distribution assembly comprising a multi-lobe cam 114, a cylinder block 115 and a distributor 116.

The cam 114 is formed from a ring arranged coaxially with the axis of rotation 111 and provided in the cover 113. The cam ring 114 is integral with the cover 113. The cam 114 comprises, on a radially internal surface, a series of lobes evenly distributed around the axis of rotation 111. Each of the lobes has a sinusoidal type overall shape.

The cylinder block 115 is mounted on the shaft 112 and is placed inside the ring forming the cam 114. It defines a plurality of cylinders oriented radially with respect to the axis of rotation 111 and leading to an external peripheral face of the cylinder block 115 facing the cam 114. A piston is mounted so as to slide radially respectively in each of the cylinders. Each piston bears on the radially internal surface of the cam 114.

The distributor 116 is mounted on the shaft 112, on a first side of the cylinder block 115 along the axis of rotation 111. The distributor 116 is adapted to apply a fluid under pressure in a controlled manner to each of the pistons, more precisely in an internal chamber of the cylinders adjoining the pistons, so that the successive pressure of the pistons on the lobes of the cam 114 drives the relative rotation of the cylinder block 115 and of the elements which are linked to it, particularly the shaft 112, with respect to the cam 114 and hence to the cover 113, or conversely. To this end, there exists and asymmetry between the number of lobes formed on the cam 114 and the number of associated pistons situated in the cylinder block 115.

The distributor 116 is also configured to exert a thrust force P against the cylinder block 115 along the axis of rotation 111. Thus, the distributor 116 and the cylinder block 115 are in fluid-tight contact with one another. The hydraulic device 100 comprises for example an elastic return element, such as a tension or compression spring, to press the distributor 116 against the cylinder block 115.

In the examples illustrated in FIGS. 6 and 7, the hydraulic device 100 is also provided with a sleeve 130 pulled over the shaft 112. The sleeve 130 is mounted movable in rotation around the shaft 112. At a first of its ends, the sleeve 130 is blocked in translation by a shoulder 117 provided on the shaft 112. At a second end of its ends, the sleeve 130 forms an axial abutment surface 118, against which the cylinder block 115 is pressed, when the distributor 116 exerts the thrust force P against the cylinder lock 115. For this purpose, a shoulder 141 is also provided in the cylinder block 115 so as to accommodate the second end of the sleeve 130. The cylinder block 115 thus extends around the second end of the sleeve 130. Thus, when the distributor 116 presses the cylinder block 115 against the axial abutment surface 118 of the sleeve 130, the thrust force P is transmitted to the shaft 112 via the sleeve 130 and the shoulder 117 of said shaft 112.

In the examples illustrated in FIGS. 6 and 7, the hydraulic device 100 comprises a clutch system configured to engage the shaft 112 in an engaged position (FIG. 6) and to disengage the shaft 112 in a disengaged position (FIG. 7). In other words, in the engaged configuration, the hydraulic device 100 drives in rotation the shaft 112, while in the disengaged configuration the hydraulic device 100 cannot drive the shaft 112 in rotation.

For this purpose, the clutch system comprises for example a fluted clutch ring 145 which, in the engaged position, mounted both on the shaft 112 and on the sleeve 130, so that the hydraulic device 100 drives in rotation both the shaft 112 and the sleeve 130 and which, in the disengaged position, is mounted only on the sleeve 130, so that the hydraulic device 100 drives only the rotation of the sleeve 130 and no longer that of the shaft 112, the sleeve 130 and the shaft 112 being free to rotate with respect to one another. In the engaged configuration, the fluted clutch ring 145 extend in part around the shaft 112, particularly the shoulder 117 of the shaft 112, and the first end of the sleeve 130. In the disengaged configuration, the fluted clutch ring 145 no longer extends around the first end of the sleeve 130. The fluted clutch ring 145 is configured to move from one configuration to another by translation along the axis of rotation 111. The fluted clutch ring 145 is for example controlled in translation by a control actuator of the clutch system. This makes it possible to couple or decouple the hydraulic device 100 from the shaft 112.

The hydraulic device 100 also comprises a set 121 of first mechanical bearings comprising at least one first mechanical bearing 121*a*, 121*b* and a set 122 of second mechanical bearings comprising at least one second mechanical bearing 122*a*, 122*b*,122*c* by means of which the shaft 112 and the cover 113 are mounted able to rotate with respect to one another. To this end, the first mechanical bearing(s) 121*a*, 121*b* and at least one of the second mechanical bearings 122*a*, 122*b* are mounted in radial contact with the shaft 112 on the one hand and the cover 113 on the other hand.

In the example illustrated in FIG. 6, the set 121 of first mechanical bearings comprises two first mechanical bearings 121*a*, 121*b* arranged on either side of the distribution assembly, particularly of the cylinder block 115 and of the distributor 116. In other words, one 121*a* of the first mechanical bearings is arranged opposite to the distributor 116 relative to the cylinder block 115 and the other 121*b* of the first mechanical bearings is arranged opposite to the cylinder block 115 relative to the distributor 116. The first mechanical bearings 121*a*, 121*b* are in direct radial contact with the shaft 112 and the cover 113.

The first mechanical bearings 121*a*, 121*b* are radial contact ball bearings each comprising an external cage and an internal cage between which are mounted the balls. The first mechanical bearings 121 are for example deep groove ball bearings. The radial contact ball bearings 121*a*, 121*b* are configured to take up axial forces with low amplitude with respect to the thrust force P.

The set 122 of second mechanical bearings is configured to take up the thrust force P exerted by the distributor 116.

In the example illustrated in FIG. 6, the set 122 of second mechanical bearings comprises a conical roller bearing 122*a* having an internal cage and an external cage between which are mounted the conical rollers. The second mechanical roller 122*a* is positioned on a first side of the distribution assembly arranged in the thrust direction of the distributor 116 against the cylinder block 115. In other words, the set 122 of second mechanical bearings is arrange opposite the distributor 116 relative to the cylinder block 115.

The conical roller bearing 122*a* is arranged so that the axial resultant of the thrust force exerted by the conical rollers on the internal cage of the conical roller gearing 122*a* is in the direction opposite to the thrust force P of the distributor 116 on the cylinder block 115. In other words, the conical roller bearing 122*a* is positioned so that its center of thrust C on the axis of rotation 111 is offset toward the distribution assembly.

The conical roller bearing 122*a* is in radial contact with the shaft 112 via the sleeve 130 on the one hand and with the cover 113 on the other hand.

Axially opposite sides of the internal cage of the second mechanical bearing 122*a* are respectively mounted in axial contact with the shaft 112 via the sleeve 130, and the cylinder block 115, which one side of the external cage of the second mechanical bearing 122*a*, opposite to the cylinder block 115 along the axis of rotation 111, is mounted in axial contact with the cover 113. A shoulder 131 is for example provided in the sleeve 130 so as to form an abutment surface against which the internal cage of the second mechanical bearing 122*a* is mounted in axial contact.

It will be understood that such an assembly makes it possible in fact to ensure that the thrust force P, exerted by the distributor 116 on the cylinder block 115, which is transmitted to the shaft 112, is taken up.

Preferably, the conical roller bearing 122*a* is mounted without axial clearance between the shaft 112 and the cover 113, so as to ensure that the axial forces in the hydraulic device 100 are taken up, and in particular to avoid having the conical roller bearing 122*a* become detached.

For this purpose, the hydraulic device 100 is for example dimensioned so that the conical roller bearing 122*a* is mounted without axial clearance between the latter and the shaft 112/the cover 113. As an alternative, an elastic ring 142 can be inserted into a groove provided in the sleeve 130 facing the side of the internal cage of the conical roller bearing in contact with the cylinder block 115, and a pre-loading spacer 143 is positioned between the elastic ring 142 and said side of the internal cage, so as to ensure the assembly of the conical roller bearing 122*a* without axial clearance. A shoulder 144 can also be provided in the cylinder block 115 to accommodate the elastic ring 142 and the pre-loading spacer 143.

In the example illustrated in FIG. 6, axially opposite sides of the internal cage of the first mechanical bearing 121*a* situated on the first side of the distribution assembly, are both mounted in axial contact with the shaft 112. Likewise, axially opposite sides of the external cage of the first mechanical bearing 121*a* located on the first side of the distribution assembly are both mounted in axial contact with the cover 113.

In addition, axially opposite sides of the internal cage of the first mechanical bearing 121*b* situated on a second side of the distribution assembly, opposite to the first side, are both mounted in axial contact with the shaft 112, while none of the axially opposed sides of the external cage is in axial contact with the cover 113 of the shaft 112. One of the axially opposite sides of the internal cage of the first mechanical bearing 121*b* is for example mounted in axial contact with the shaft 112 by means of an elastic ring 132 inserted in a groove provided in the shaft 112.

According to a variant of the hydraulic device 100 illustrated in FIG. 6, the hydraulic device 100 is configured to function with two operational cylinder capacities. For this purpose, the hydraulic device 100 includes a cylinder capacity selection slide valve, allowing passage from one capacity to another. This slide valve can be a symmetrical slide valve, meaning that the hydraulic device 100 has no preferred direction (same behavior in forward and reverse of the vehicle when the hydraulic device 100 is a motor).

Figure 8:
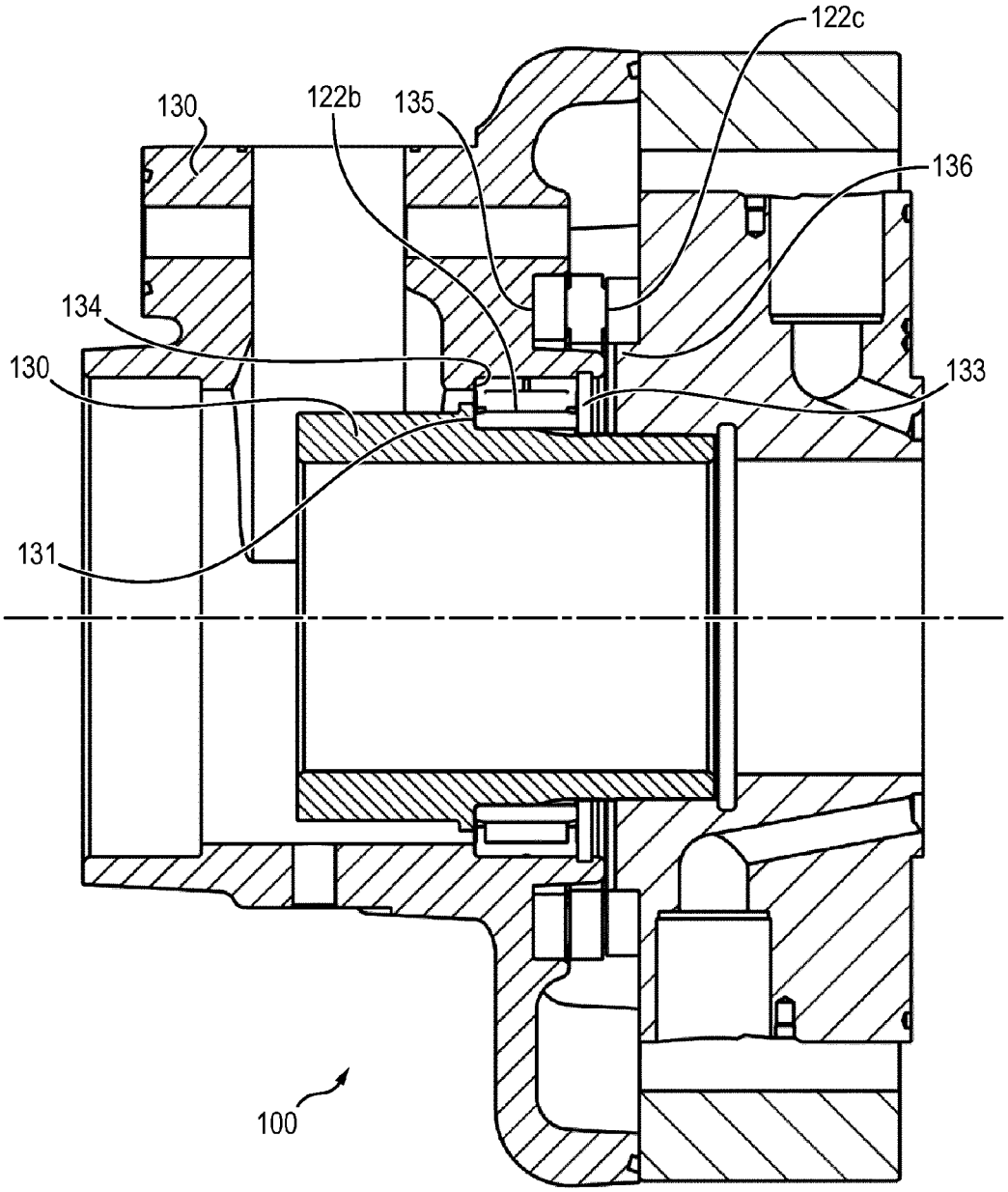
FIG. 8 shows a partial schematic section view of a variant embodiment of the hydraulic device illustrated in FIG. 6.

In the example illustrated in FIG. 8, the set 122 of second mechanical bearings comprises a needle bearing 122*b* having an external cage and an internal cage between which the needles are mounted, and a cylindrical roller thrust bearing 122*c* having a first cage and a second cage between which cylindrical rollers are mounted.

The internal cage of the needle bearing 122*b* is in radial contact with the shaft 112 via the sleeve 130, while its external cage is in direct radial contact with the cover 113.

Axially opposite sides of the internal cage of the needle bearing 122*b* are respectively mounted in axial contact with the shaft 112, via the sleeve 130 and for example the shoulder 131 provided in said sleeve 130, and the cover 113, for example by means of an elastic ring 133 inserted into a groove provided in the cover 113. Axially opposite sides of the external cage of the needle bearing 122*b* are both mounted in axial contact with the cover 113, for example by means of a shoulder 134 forming an abutment surface provided in the cover 113 on the one hand, and on the other hand by means of the elastic ring 133 of the cover 113.

Thus the needle bearing 122*b* makes it possible to align the sleeve 130 and the cover 113.

The first cage of the cylindrical roller thrust bearing 122*c* is mounted in axial contact with the cover 113 and the second cage of the cylindrical roller thrust bearing 122*c* is mounted in axial contact with the cylinder block 115.

Radially opposite sides of the first cage and of the second cage, corresponding respectively to the radially external and radially internal sides of the first cage and of the second cage of the cylindrical roller thrust bearing 122*c* are respectively mounted in radial contact with the cover 112 and the cylinder block 115. For this purpose, a groove 135 is for example provided in the cover 113 so as to receive the first cage of the cylindrical roller thrust bearing 122*c*. In addition, a shoulder 136 is for example provided in the cylinder block 115 so as to receive the second cage of the cylindrical roller thrust bearing 122*c*.

Thus, the cylindrical roller thrust bearing 122*c* makes it possible to absorb the thrust force P exerted by the distributor 116 on the cylinder block 115, which is transmitted to the shaft 112.

Preferably, the cylindrical roller thrust bearing 122*c* is mounted without axial clearance between the cover 113 and the cylinder block 115, so as to ensure that the axial loads in the hydraulic device 100 are taken up and in particular to avoid that the cylindrical roller thrust bearing 122*c* becomes detached. For this purpose, the hydraulic device 100 is dimensioned so that the cylindrical roller thrust bearing 122*c* is mounted without axial clearance between the latter and the cover 113/the cylinder block 115.

Moreover, so as to minimized the bulk of the hydraulic device 100, the cylindrical roller thrust bearing 122*c* has an inner diameter greater than the inner diameter of the needle bearing 122*b* so that the two bearings 122*b*, 122*c* are arranged concentrically, the cylindrical roller thrust bearing 122*c* extending or example at least partially around the needle bearing 122*b*.

The hydraulic devices 10, 100 illustrated in FIGS. 2 through 11 have the advantage of ensuring that the thrust force P of the distributor against the cylinder block 15, 115 is taken up, while still allowing a reduction in the pre-load force applied to the mechanical bearings 21 and 22; 121 and 122, and therefore reducing their resistance, and thus increasing their lifetime. In addition, the axial dimension of such hydraulic devices 10, 100 can be reduced insofar as ball bearings have a reduced axial dimension compared to the axial dimension of a conical roller bearing. Finally, ball bearings have the advantage of being less costly and lighter than conical roller bearings.

The invention claimed is:

1. A hydraulic device with radial pistons comprising:

a shaft arranged along an axis;

a cover forming a casing element, the cover and the shaft being free to rotate with respect to one another;

a distribution assembly comprising:

a multi-lobe cam;

a cylinder block radially facing the cam, said cylinder block comprising a plurality of cylinders wherein are arranged pistons guided so as to slide radially in the respective cylinders of the cylinder block and bearing on the lobes of the cam;

a distributor configured to exert a thrust force against the cylinder block along the axis of the shaft so as to successively apply a fluid under pressure to said pistons;

a first mechanical bearing mounted in radial contact between the cover and the shaft, and a set of second mechanical bearings comprising at least one second mechanical bearing mounted in radial contact between the cover and the shaft, said set of second mechanical bearings being configured to take up the thrust force exerted by the distributor;

wherein the first mechanical bearing is a radial contact ball bearing, wherein the set of second mechanical bearings is positioned on a first side of the distribution assembly arranged in the thrust direction of the distributor against the cylinder block, and wherein the first mechanical bearing is positioned on a second side of the distribution assembly arranged opposite to the thrust direction of the distributor against the cylinder block.

2. The hydraulic device according to claim 1, wherein the shaft comprises an axial abutment surface against which the cylinder block is pressed, when the distributor exerts the thrust force against the cylinder block.

3. The hydraulic device according to claim 1, wherein the second mechanical bearing is a conical roller bearing or an oblique contact ball bearing.

4. The hydraulic device according to claim 3, wherein the second mechanical bearing comprises an external cage and an internal cage between which rolling elements are mounted, and wherein the axially opposite sides of the internal cage and of the external cage are respectively mounted in axial contact with the shaft and the cover, so as to take up the thrust force.

5. The hydraulic device according to claim 3, comprising a sleeve mounted in rotation around the shaft and by means of which the second mechanical bearing is mounted in radial contact and in axial contact with the shaft.

6. The hydraulic device according to claim 1, wherein the set of second mechanical bearings comprises a radial contact ball bearing and a ball thrust bearing.

7. The hydraulic device according to claim 6, wherein the ball thrust bearing comprises a first cage and a second between which balls are mounted, wherein the radial contact ball bearing of the set comprises an internal cage and an external cage between which are mounted the balls, and wherein the first cage is mounted in axial contact with the shaft, and axially opposite sides of the external cage of the radial contact ball bearing of the set are respectively mounted in axial contact with the second cage of the ball thrust bearing and the cover so as to take up the thrust force.

8. The hydraulic device according to claim 1, wherein the set of second mechanical bearings comprises a needle bearing and a cylindrical roller thrust bearing.

9. The hydraulic device according to claim 8, wherein the cylindrical roller thrust bearing comprises a first cage and a second cage between which are mounted the cylindrical rollers, the first cage of the cylindrical roller thrust bearing being mounted in axial contact with the cover and the second cage of the cylindrical roller thrust bearing being mounted in axial contact with the cylinder block, radially opposite sides of the first cage and of the second cage of the cylindrical roller thrust bearing being respectively mounted in radial contact with the cover and the cylinder block.

10. The hydraulic device according to claim 8, wherein the needle bearing (122*b*) comprises an internal cage and an external cage between which the needles are mounted, axially opposite sides of the internal cage of the needle bearing (122*b*) being respectively mounted in axial contact with the shaft (112) and the cover (113), and axially opposite corners for the external cage of the needle bearing (122*b*) being mounted in axial contact with the cover (113).

11. The hydraulic device according to claim 8, comprising a sleeve mounted in rotation around the shaft and by means of which the needle bearing is mounted in radial contact with the shaft.

12. The hydraulic device according to claim 1, wherein the set of second mechanical bearings is mounted without axial clearance between the shaft and the cover.

13. The hydraulic device according to claim 4, wherein the external cage of the second mechanical bearing is mounted in axial contact with the cover by means of a pre-loading spacer, so as to ensure assembly without axial clearance of the set of second mechanical bearings between the shaft and the cover.

14. The hydraulic device according to claim 6, wherein the external cage of the radial contact ball bearing of the set is mounted in axial contact with the second cage of the ball thrust bearing by means of a pre-loading spacer so as to ensure assembly without axial clearance of the set of second mechanical bearings between the shaft and the cover.

15. The hydraulic device according to claim 1, comprising two first mechanical bearings arranged on either side of the distribution assembly, said first mechanical bearings being radial contact ball bearings.

16. The hydraulic device according to claim 1, wherein the first mechanical bearing comprises an internal cage and an external cage between which are mounted the balls, and wherein the axially opposite sides of the external cage and of the internal cage are respectively mounted in axial contact with the cover and the shaft so as to obtain closure of the axial forces by the cover.

17. The hydraulic device according to claim 1, wherein the set of second mechanical bearings is positioned on the second side of the distribution assembly arranged opposite to the thrust direction of the distributor against the cylinder block.

18. The hydraulic device according to claim 17, wherein the first mechanical bearing is positioned on the first side of the distribution assembly arranged in the thrust direction of the distributor against the cylinder block.

19. The hydraulic device according to claim 18, wherein the first mechanical bearing comprises an internal cage and an external cage between which are mounted the balls, and wherein the axially opposite sides of the internal cage are both mounted in axial contact with the shaft so as to ensure closure of the forces by the shaft.

20. The hydraulic device according to claim 1, wherein the shaft is hollow and configured to be mounted around a shaft, particularly a differential shaft, said hydraulic device comprising a first ring seal mounted in radial contact with an external surface of an end of the shaft on the one hand and the cover on the other hand and a second ring seal mounted in radial contact with an internal surface of said end of the shaft on the one hand and configured to be mounted in radial contact with the shaft on the other hand.

21. The hydraulic device according to claim 20, comprising a lock ring comprising a first and a second annular portions and connected to one another by an intermediate portion, the first annular portion of the lock ring being mounted on the external surface of the end of the shaft and the first ring seal being mounted in radial contact with the end of the shaft by means of said first annular portion, the second annular portion of the lock ring extending from the intermediate portion distancing itself from the end of the shaft, and the second ring seal being mounted in radial contact with the end of the shaft by means of said second annular portion.

22. The hydraulic device according to claim 20, wherein the internal surface of the end of the shaft is provided with a shoulder forming a space which accommodates the second ring seal.

23. The hydraulic device according to claim 22, also comprising an annular band mounted on the external surface of the end of the shaft and by means of which the first ring seal is in radial contact with the end of the shaft.

24. The hydraulic device according to claim 21, wherein the external surface of the end of the shaft is provided with a shoulder accommodating the first portion of the lock ring or the annular band.

25. The hydraulic device according to claim 20, wherein the first and the second ring seals are arranged one around the other overall.

26. The hydraulic device according to claim 23, wherein the external surface of the end of the shaft is provided with a shoulder accommodating the first portion of the lock ring or the annular band.

27. The hydraulic device according to claim 12, wherein the external cage of the second mechanical bearing is mounted in axial contact with the cover by means of a pre-loading spacer, so as to ensure assembly without axial clearance of the set of second mechanical bearings between the shaft and the cover.

28. The hydraulic device according to claim 12, wherein the external cage of the radial contact ball bearing of the set is mounted in axial contact with the second cage of the ball thrust bearing by means of a pre-loading spacer so as to ensure assembly without axial clearance of the set of second mechanical bearings between the shaft and the cover.

* * * * *